United States Patent [19]

Reyner

[11] Patent Number: 4,909,420

[45] Date of Patent: Mar. 20, 1990

[54] REGULATED PRESSURIZED DISPENSER AND METHOD

[76] Inventor: Ellis M. Reyner, 1050 George St., 16H, New Brunswick, N.J. 08901

[21] Appl. No.: 21,617

[22] Filed: Mar. 2, 1987

Related U.S. Application Data

[63] Continuation-in-part of Ser. No. 671,048, Nov. 13, 1984, Pat. No. 4,646,946, which is a continuation-in-part of Ser. No. 413,498, Sep. 2, 1982, abandoned.

[51] Int. Cl.[4] ..... B65D 83/14

[52] U.S. Cl. ..... 222/386.5; 222/399

[58] Field of Search ..... 222/386.5, 389, 399; 60/721

[56] References Cited

U.S. PATENT DOCUMENTS

| | | | |
|---|---|---|---|
| 4,376,500 | 3/1983 | Banks et al. | 222/386.5 |
| 4,478,044 | 10/1984 | Magio | 222/386.5 X |
| 4,491,250 | 1/1985 | Liebermann | 222/386.5 |
| 4,510,734 | 4/1985 | Banks et al. . | |
| 4,553,685 | 11/1985 | Magid . | |
| 4,646,946 | 3/1987 | Reyner | 222/386.5 |
| 4,679,706 | 7/1987 | Magid et al. | 222/386.5 X |

*Primary Examiner*—Kevin P. Shaver

[57] ABSTRACT

A flexible closed plastic pouch disposable within a product container for supplying dispensing pressure therein. A plurality of pocket members disposed at spaced positions within said pouch with their openings facing the interior of the pouch. Each pocket member having an extension of a predetermined length attached at its end to the interior of first of two facing wall members of the pouch. Each pocket member enclosing a predetermined quantity of first component of a two-component gas generation system and being releasably closed by one of a plurality of closure members, each of said closure members having an extension of a predetermined length attached at its end to the interior of the second of the two facing walls of the pouch. The pouch contains a second component of said two-component gas generation system and a starting device encapsulated within a delay device to intially generate a predetermined quantity of pressurizing gas after a delay of predetermined period of time. The pressurizing gas inflates and expands the pouch within the container under pressure. Due to the dispensing of the product, the pouch expands further and causes sequential separation of the pocket members from their closure members and serial opening of each pocket member to add predetermined quantities of aliquot of the first component to the second component and further generate additional quantities of pressurizing gas. The internal pressure within the container is maintained substantially within a range of predetermined maximum and minimum pressure levels until dispensing the product from the container is completed.

16 Claims, 4 Drawing Sheets

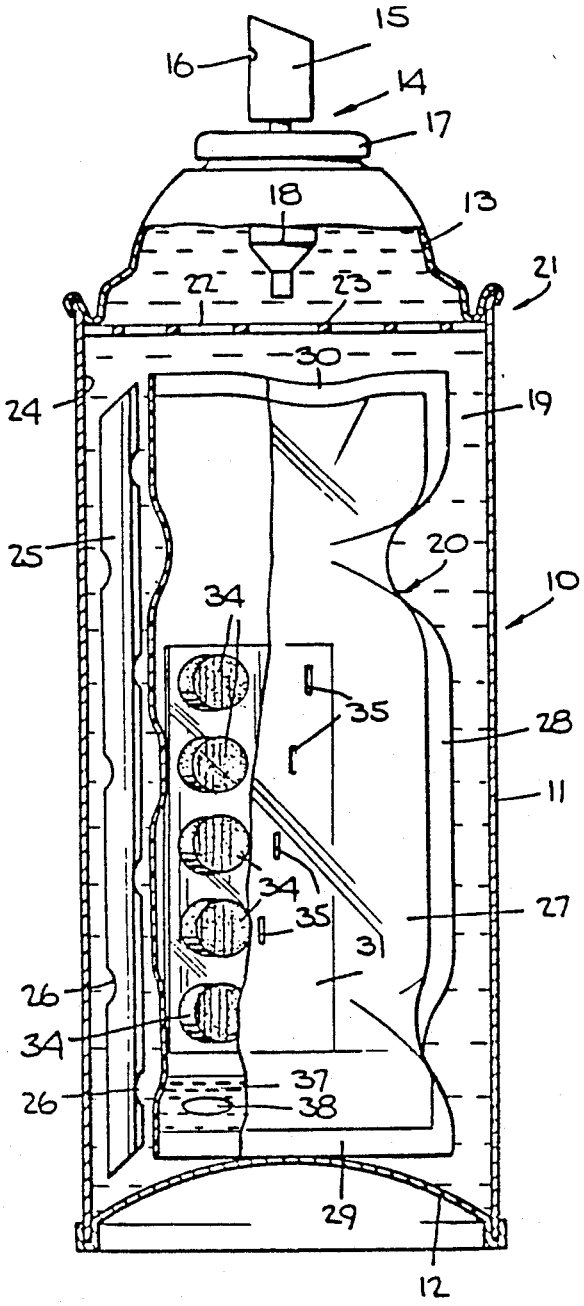
Fig. 1.
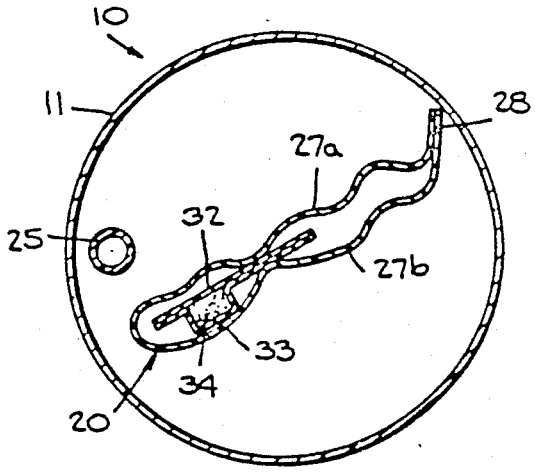
Fig. 2.
Fig. 3.
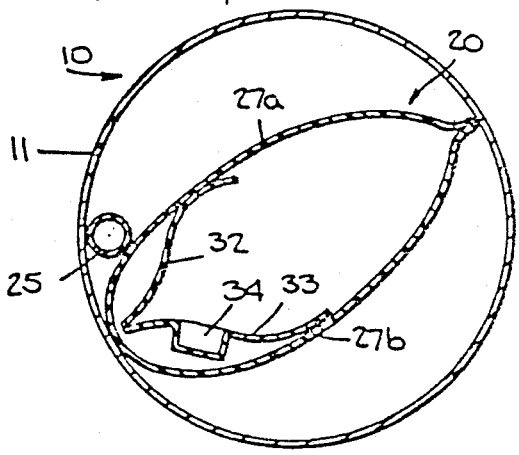

Fig. 8.
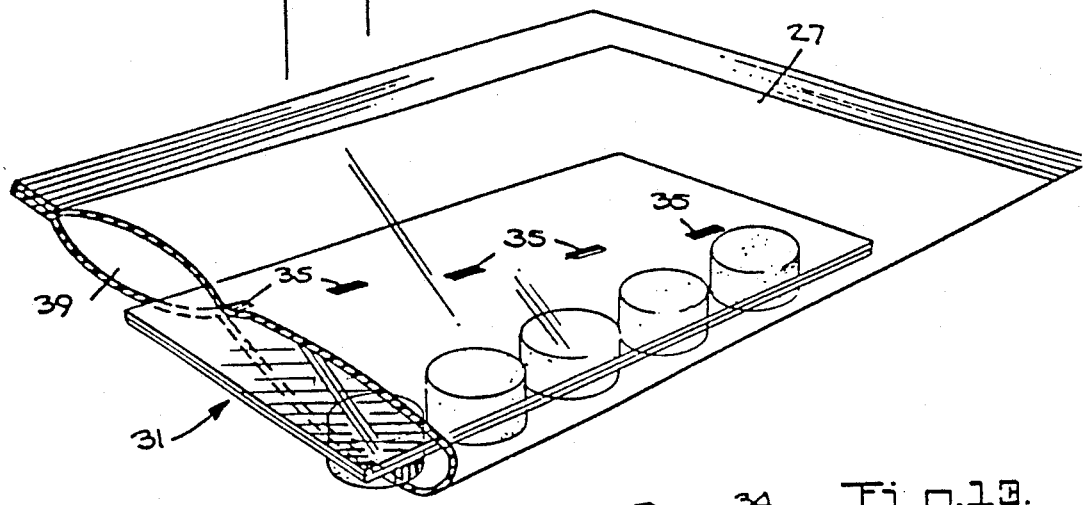
Fig. 13.
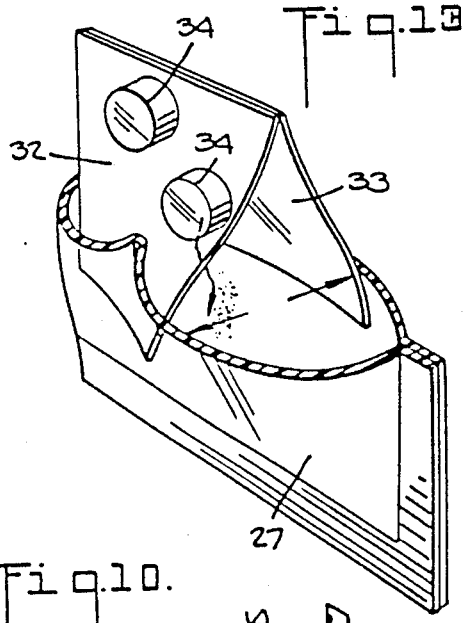
Fig. 12.
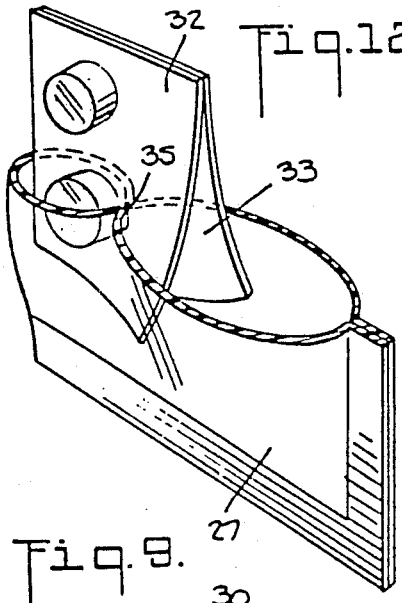
Fig. 9.
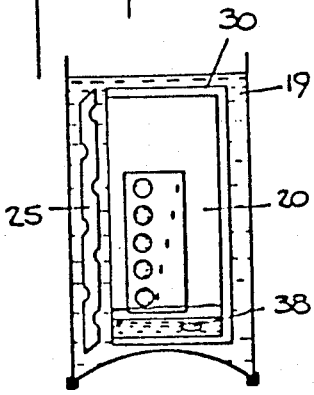
Fig. 10.
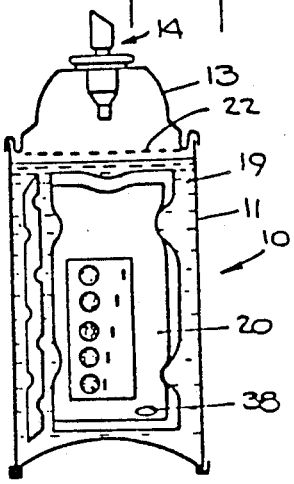
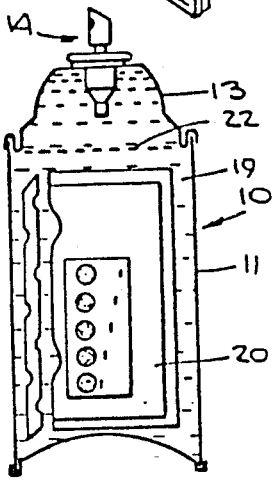
Fig. 11.

REGULATED PRESSURIZED DISPENSER AND METHOD

This is a continuation in part of U.S. patent application Ser. No. 671,048, dated Nov. 13, 1984, entitled "Pressure Generating Apparatus And Method", and issued as U.S. Pat. No. 4,646,946, which is a continuation in part of U.S. patent application Ser. No. 413,498, filed on Sept. 2, 1982, which was abandoned.

BACKGROUND OF THE INVENTION

For a long time there has been a need for a self regulated pressure generating system for use in product dispensing containers that is isolated from, and is not dispensed with, the product. Environmental considerations and safety precautions, as well as physical or chemical incompatabilities, toxicity, and contamination are some of the factors which emphasized this need.

Most other aerosol type dispensers generally were operable only in an upright position, otherwise premature exhaustion of the dispensing medium would result with a substantial loss of usable product which would remain indispensable in the container due to loss of dispensing pressure.

Dispensers pressurized with propellants have other deficiencies such as incompatibilities, non-uniform dispensing pressure, temperature sensitivity, leakage and unreliability and solubility problems.

The present invention provides a dispensing mechanism which overcomes the above-mentioned deficiencies of the prior art devices and provides additional novel features and advantages, and a wider range of uses, than were possible with devices used heretofore.

BRIEF SUMMARY OF THE INVENTION

Expulsion means for developing and substantially maintaining within predetermined maximum and minimum range gaseous dispensing pressure in a container from which a product is to be dispensed, comprising an enclosed fluid impermeable flexible pouch disposed within the container and having a pair of facing wall members. A plurality of pocket members in spaced relation to one another, each contains a predetermined quantity of first component of a two component gas generation mixture, and a closure member releasably closes each of said pocket members. This plurality of closed pocket members is disposed within the pouch, and each has a pocket extension member and a closure extension member affixed by weld portions to a predetermined spot on the interior of one of the facing wall members of the pouch. The first component of the two-component gas generation mixture is e.g. citric acid. The second component of said two-component gas generation mixture is e.g. sodium bicarbonate and water is disposed within the pouch and externally of said closed pocket members. When these two components are mixed, they react and generate carbon dioxide gas. Starting delay means, e.g., a rupturable or dissolvable capsule containing a predetermined quantity of first component citric acid, is disposed within the pouch in contact with the second component for causing the initial generation of carbon dioxide gas after a prescribed period of time. As the product is discharged intermittantly from the container, the pouch inflates and gradually expands in increments and displaces the product evacuated from the container. Each pocket member sequentially separates from its respective closure member as the pouch expands within the container to thereby open and empty its content into admixture with the second component to react and generate an additional predetermined quantity of pressurizing carbon dioxide gas within pouch (27).

One object of the present invention is to provide a dispensing mechanism to fill in the need of providing consumer products pressurized under maximum and minimum pressure levels.

Another object of this invention is to provide dispensing mechanism to fill the void where there is no suitable propellant for specific products required to be dispensed under specific pressure levels.

Another object of this invention is to provide a safe and efficient pressurized system which conforms with the laws and regulations of various government agencies.

Other objects of the precise nature of the present invention will become evident from the following description and accompanying drawings in which each of the various components has the same reference numeral in their different views.

DESCRIPTION OF THE DRAWINGS

FIG. 1 is an elevation sectional view of an aerosol dispensing container including an expulsion means embodiment of the present invention shown in a fragmentary cutaway view;

FIG. 2 is a sectional plan view of the structure shown in FIG. 1 showing the expulsion means in initial collapsed condition.

FIG. 3 is a sectional plan view of the structure shown in FIG. 1, showing the expulsion means in intermediate expanded condition;

FIG. 8 is an enlarged schematic representation, showing heat sealing of the envelope sides to the inner walls of the pouch;

FIG. 9 through 11 are reduced sectional elevations showing assembly of the pouch containing the envelope inside an aerosol type dispenser;

FIGS. 12 and 13 are enlarged fragmentary schematic views showing separation of the envelope sides during expansion of the pouch to open the pocket members;

DETAILED DESCRIPTION

Figure 4:
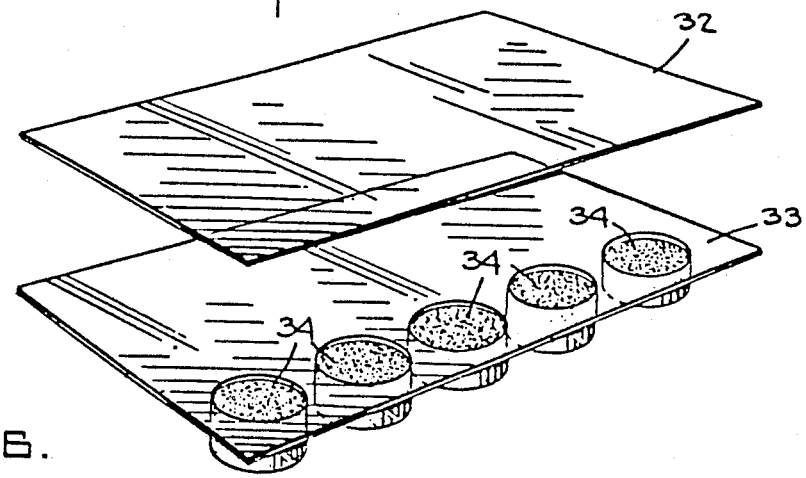
FIG. 4 is an enlarged isometric view of the two envelope sheets of an embodiment of the invention prior to assembly.
Figure 6:
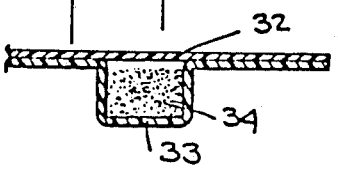
FIG. 6 is a sectional view taken along lines 6—6 of FIG. 5.

Referring to the drawings, in which each of the various components has the same reference numeral in the different views, and in particular FIGS. 1–3, a fluid impermeable dispensing container is shown and designated generally by reference (10). Container (10) has a cylindrical body or sidewall (11), inwardly dished bottom (12) and bell-shaped top (13) in which is mounted a conventional spring valve assembly (14). Container (10) and its component parts just described can be fabricated from any suitable material such as thin gauge aluminum or other metal, or even plastics, depending on the product to be dispensed and any governing safety specifications that might be involved. Valve assembly (14) is also of conventional design having plunger and spray head (15) carrying spray orifice 16, suitable constructed of plastic material, and internal parts (not shown) such as a spring, ball valve and mounting ring (17) and bottom intake member (18) which may be of metal and/or plastic consistent with the previously mentioned requirements.

Within container (10) is flowable product (19) and expulsion assembly (20) which is the subject of the present invention and as will be seen, generates and maintains gas pressure within container (10) to enable product (19) to be dispensed on demand.

At the upper end (21) of the interior of cylindrical body (11) is a perforated or foraminous barrier member (22) having a plurality of holes (23) distributed throughout its surface. Also affixed to inner surface (24) of sidewall (11) and extending longitudinally there along is a perforate tube member (25) having a plurality of holes (26) at spaced positions around and along said tube member (25). The function of barrier member (22) and tube member (25) is to insure trouble-free operation of the dispenser and prevent expulsion assembly (20), as it expands in the manner to be described, from blocking off or plugging the interior of the container either laterally/circumferentially or plugging off valve bottom intake member (18).

Expulsion assembly as shown is disposed within container (10) without being attached or anchored to container (10), although it may, if desired be so connected. Assembly (20) is comprised of generally regular envelope, bag or pouch (27) which is constructed of a flexible, fluid impermeable plastic material, such as, for example, polyethylene or polypropylene and may be fabricated from a sheet of plastic by folding it into overlaid halves (27*a*), (27*b*) which are then sealed or adhered by suitable means along their respective contacting side, bottom and top edges (28), (29), (30) respectively to form sealed enclosure as shown in FIG. (1) to (3) inclusive.

Disposed within pouch (27) is fluid impermeable flexible plastic sandwich or enfoldment (31), having a pair of facing wall members (32) and (33) releasably adhered to one another (see also FIGS. (2) through (6) and permanently attached on their exterior surfaces by suitable means, such as heat sealed protions (35) to respective interior sides (27*c*) and (27*d*) respectively. Portions of one wall member (33) have plurality of cup-shaped depressions, cavities or pocket members (34) disposed inwardly from one surface thereof at spaced positions, and other portions of wall member (33), each forms an extension member (a) as in FIG. (15), to each pocket member. Each extension member extends from the edge of the opening of its respective pocket member to the edge of wall member (33). Each extension ends at a predetermined distance from the edge of the opening of its pocket member. Each extension is affixed permanently at its end by one of weld portions (35) to predetermined locations or spots on the interior wall (27*d*). These spots on interior wall (27*d*) are on the same locations as weld portions (35) shown in the drawing and are superimposed and concealed by them. They may be referred to in the drawings by the same numeral (35). The other wall member (32) is substantially flat and has lidding area members or closure members which close each of the respective facing member of pockets (34) and releasably adhered to it. Pocket members (34) are superimposed on these closure members in the drawings, see FIG. (17). Other areas of wall member (32), each forms an extension member (b) as in FIG. (15), to each closure member. Each closure extension member extends from the edge of each of closure member to the edge of wall member (32). Each extension ends at a predetermined distance from the edge of its closure member. Each extension is affixed permanently at its end by one of weld portions (35) to a predetermined location or spot on interior wall (27*c*). These spots on interior wall (27*c*) are on the same locations and are superimposed by weld portions (35) in the drawings. They may be referred to in the drawing by the same numeral (35). Each of pocket members (34) is releasably closed by wall member (32) to encapsulate within each of pocket members (34) a predetermined quantity of aliquot of component (36), which may be either in the form of powder or a solution. In the interior of pouch (27) is component (37) solution. Also disposed in component (37) is starting means (38), which as shown is in the form of dissolvable capsule and contains an initial charge of component (36) which, after a predetermined period of time after assembly of pouch (27) in container (10), filling container (10) with product (19) and placing tubing (25) and barrier (22) in place and capping it with the top (13) and associated parts, capsule (38) dissolves and causes component (36) contained therein to mix and react with component (37) and generate the initial quantity of pressurizing gas, thereby, inflating and expanding bag or pouch (27) and providing dispensing pressure within container (10).

It is to be understood that cavities or pockets (34) and capsule (38) may carry component (36) e.g. citric acid in powder or in solution and component (37) may be sodium bicarbonate and water, or the two carbon dioxide gas generating components can be switched the other way around.

The pouch (27) in one preferred embodiment is constructed of a three layer laminated film having a middle layer of saran, the external layer of Mylar about 0.5 mils and the inside layer (interior of the pouch) being low density polyethylene of about 1.5 mils, and the saran layer is only deposited from spray. The characteristics required or desired in said pouch is that it be non-toxic, have sufficient mechanical strength and chemical stability, and flexible but not appreciably stretchable, and the interior facing surfaces of the pouch be heat sealable. Pouch (27) can also be constructed from other films such as impervious or non-impervious, non-laminated or laminated with plastics, foil or treated fabrics.

Wall member (32) is fabricated from the same material which contacts the interior of pouch (27) and is of compatible plastic material, e.g. low density polyethylene. In one preferred embodiment, it has an overall thickness of about 4.5 mils and is a three layer sandwich of about 0.5 mils Mylar in the middle and about 2.0 mils low density polyethylene on either sides.

Wall member (33) carrying the cup-shaped depressions (34) adapted for deep drawing and is in one preferred embodiment a laminated plastic sheet having an exterior layer (the layer in contact with the interior of pouch (27)) of low density polyethylene of about from 0.5 to about 20 mils thick and an interior layer (the other side) of polypropylene of from about 0.1 to about 3.75 mils thick or higher.

While for most practical applications of the invention, components (36) and (37) as citric acid and sodium bicarbonate respectively are normally preferred, it is possible that under particular circumstances other material may be suitable such as, for example, dilute hydrochloric acid (e.g. 10 to 30%) may replace the citric acid, and lithium carbonate or calcium carbonate may replace the sodium bicarbonate.

The radio-activity at the surface of the dispenser and its component parts and accessories as well as that of the product discharged therefrom is within human tolerence, and does not exceed 0.1 milliroentgen per hour at the time of assembly. Reference is made to U.S. Pat. No. 4,646,946 owned by the common assignee hereof.

Various other delay means can be employed in addition to dissolvable capsule (38).

The method of assembly requires the following data to be determined:

1. The maximum and minimum pressure levels under which product (19) is to be discharged out of container (10).

2. The increases in the size of expanding pouch (27) during the period when its internal pressure drops sequentially from predetermined maximum to predetermined minimum pressure levels.

3. The number of the releasably closed pocket members (34) required to be disposed within pouch (27), and the order of their sequential opening within pouch (27) as the product is dispensed from container (10), the quantities of first component (36) to be enclosed in each of these releasably closed pocket members (34) as well as in capsule (38), the quantity of second component (37) and a solvent, water in this case, to be deposited within pouch (27), and the lengths of each of the pocket and closure extension members of each of said closed pocket members according to the order of their sequential opening.

For all practical purposes, the internal pressure within pouch (27) or expulsion means (20) is equivalent to the internal pressure of container (10).

As capsule (38) disintegrates, its content of component (36) is released and reacts with second component (37) within pouch (27), and generates the initial predetermined quantity of pressure generating gas which raises the internal pressure therein to the predetermined maximum pressure level, and pouch (27) inflates and expands within container (10).

As product (19) is dispensed, and thereby pouch (27) expands and increases in size further and displaces the space vacated by product (19) within container (10), each quantity of component (36) encapsulated in each of closed pocket members (34) is released sequentially and reacts with component (37) within pouch (27) and generates sequentially additional predetermined quantities of pressurizing gas therein each time the internal pressure within pouch (27) drops from predetermined maximum pressure level to predetermined minimum pressure level. These additional quantities of pressurizing gas raise the internal pressure within pouch (27) from predetermined minimum pressure levels to predetermined maximum pressure levels. The increases in the size of pouch (27) cause its facing walls to push outwardly, and thereby the distance between interior wall members (27*c*) and (27*d*) as well as the distances between identifiable spots on these two walls increase. Eventually the pocket members of each of closed pocket members (34) separate from their respective closure members and said closed pocket members open sequentially and discharge their contents, which react with component (37) and generate sequentially additional predetermined quantities of pressurizing gas, which raise the pressure therein to predetermined maximum levels. The internal pressure within pouch (27) alternates between predetermined maximum and minimum pressure levels, until dispensing product (19) is completed.

Figure 5:
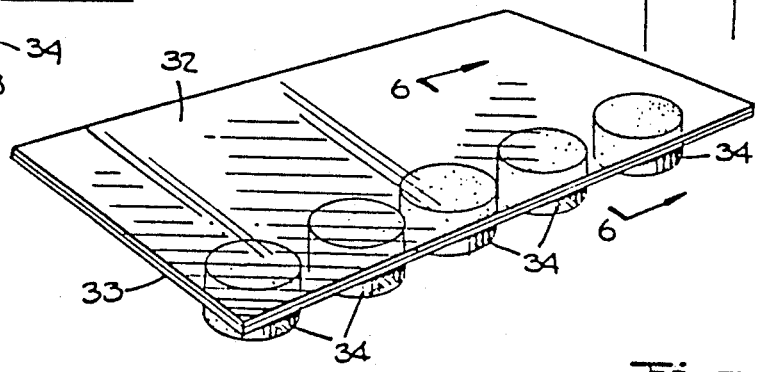
FIG. 5 is an enlarged isometric view of the two envelope sheets of FIG. 4 in assembled condition.
Figure 7:
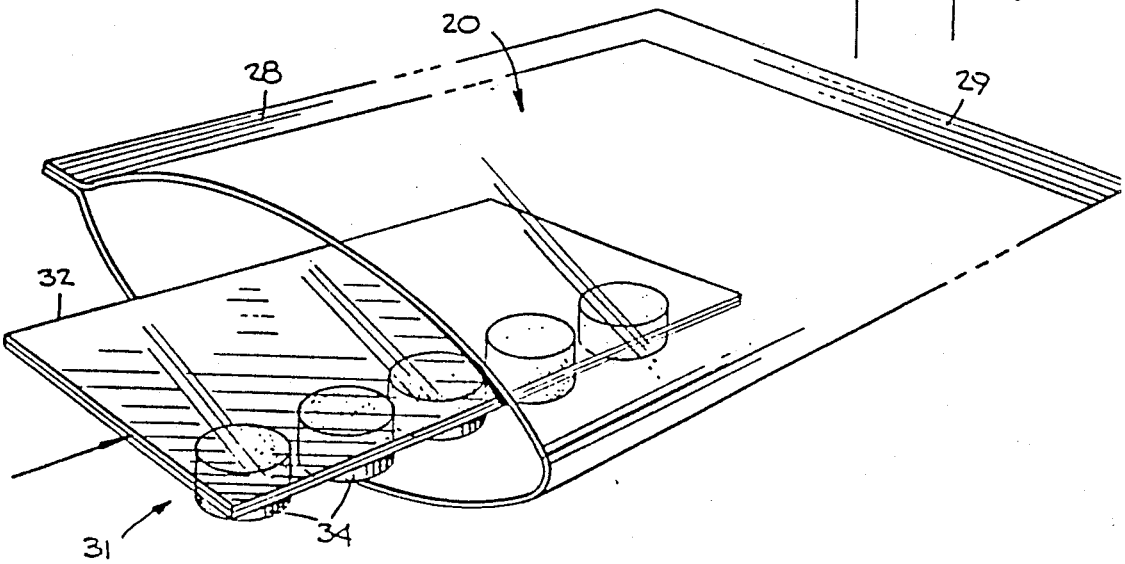
FIG. 7 is an enlarged schematic representation showing, the method of insertion of the envelope into the pouch.
Figure 17:
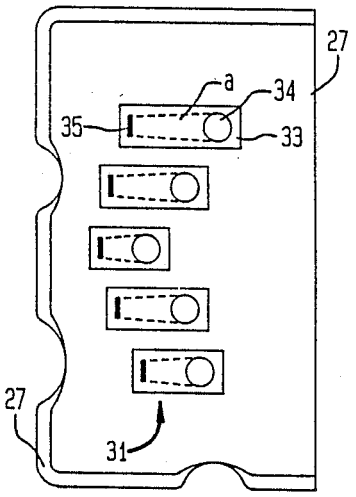
FIG. 17 is a schematic representation of the arrangement of a plurality of envelopes, independent from each other disposed within the pouch and each having a single pocket member.
Figure 14:
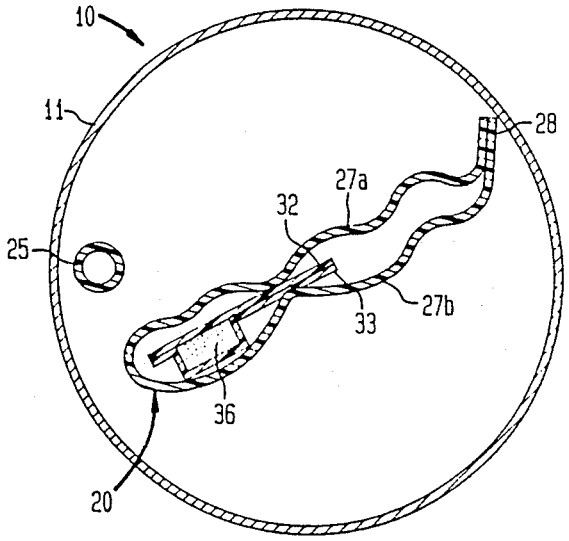
FIG. 14 is another cross section view of the structure shown in FIG. 1, showing the expulsion means in initial collapsed condition.
Figure 16:
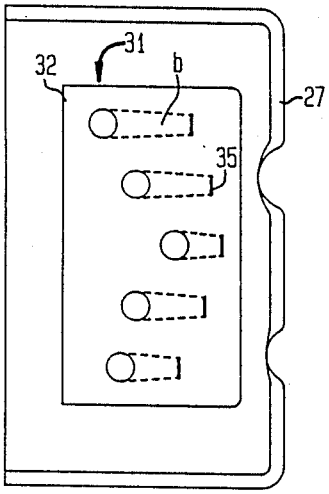
FIG. 16 is a schematic representation of an arrangement of the closure members and the pattern of attachment of the exterior sides of their extensions to the interior of the facing wall of the pouch.
Figure 15:
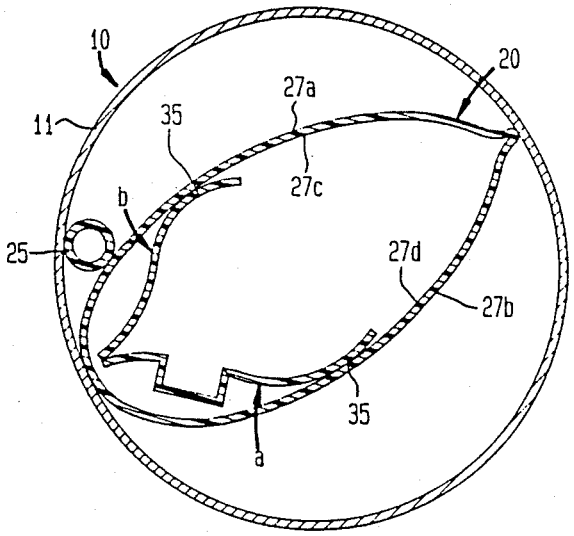
FIG. 15 is another sectional plan view of the device shown in FIG. 1, showing the expulsion means in intermediate expanded condition. Also shown are the exterior surfaces of the extensions of the pocket and closure members attached to the interior of the facing walls of the pouch.

The method of assembly is depicted schematically in FIGS. (4) to (8) and (9) to (11). By heating and drawing portions of sheet (33) in a mold, cavities or pockets are formed on portions of sheet (33), and extension members to each of pockets (34) are formed on other portions of sheet (33). Each of these extensions extends from the edge of the opening of each member of pockets (34) and ends at the edge of sheet (33). Each extension ends at a predetermined distance from the edge of the opening of its pocket member. Predetermined quantities of component (36) e.g. citric acid are deposited in each member of pockets (34). Each of these quantities and the length of the extension of each pocket member are predetermined according to the order of the sequential opening of each of closed pocket member in the manner to be described. Then sheet (32) is overlayed on sheet (33) and they are releasably sealed together (FIG. 5) to close each of pockets (34), and thereby form enfoldment (31). Portions of sheet (32) become liddings or closures to each member of pockets (34). Other portions of sheet (32) become extensions to each of these closure member to the edge of wall member (32). Each extension ends at a predetermined distance from the edge of its closure member. The length of the extension of each closure is predetermined according to the order of the sequential opening in the manner to be described. Enfoldment (31) is inserted into the open end (30) of pouch (27). The exterior walls of enfoldment (31) are heat sealed together permanently by weld portions (35) as follows: The end of each extension member of pocket members (34) is affixed permanently to predetermined identified location or spot on interior wall (27*d*) by one of weld portions (35), and the end of each extension member of the closure members is affixed permanently to predetermined identified location or spot on interior wall (27*c*) by one of weld portions (35),(FIG.8). A predetermined quantity of component (37) with water, and capsule (38) are deposited within pouch (27), and then upper edge (30) is closed and heat sealed permanently to completely enclose the contents in pouch (27) and thereby complete the assembly of expulsion means (20). This expulsion means assembly (20) is then inserted into container (10) and product (19) is added therein around it, barrier (22) and perforated tubing (25) are put into place, and top (13) is affixed to container (10) (FIG. 10). After elapse of a prescribed period of time, starting capsule (38) has dissolved and generates a predetermined quantity of pressurizing gas, e.g. carbon dioxide gas, which inflates, pressurizes and causes pouch (27) to expand, and the dispenser is now ready for use (FIG. 11). FIGS. (3), (12), and (13) show schematically how interior walls (27*c*) and (27*d*) of pouch (27) are permanently affixed and welded at weld portions (35) to the exterior of wall members (32) and (33), and how the expansion of pouch (27) causes the closure members to separate from their respective pocket members and open and expose their content of first component (36) to admix and react with the second component (37) and water within pouch (27) and thereby generate additional predetermined quantities of said pressurizing gas.

Enfoldment (31) may also be sliced in suitable patterns to form smaller units of enfoldment (31), each comprised of a single closed pocket member (34) encapsulating a predetermined quantity of component (36). Each pocket and its closure has an extension extending to the edges of sheet (33) and (32) respectively as described above. Each of single closed pocket members (34) may be disposed within pouch (27) unattached to the other closed pocket members. Each extension of pocket members (34) ends at a predetermined distance from the edge of the opening of its respective pocket member, and each extension of the closure members ends at a predetermined distance from the edge of its respective closure member. Each of these ends defined a free end of their respective extensions.

In a dispenser of the following description, the method of determination of, a. the increases in the pouch size each time the pressure therein drops from the predetermined maximum to the predetermined minimum pressure levels, b. the number of closed pocket members (34) to be disposed within pouch (27).

c. the quantity of first component (36) e.g. citric acid to be encapsulated in each of closed pocket members (34) and capsule (38), d. the length of each extension of the pocket and closure members of each of closed pockets (34), e. the quantity of second component (37) e.g. sodium bicarbonate and solvent, e.g. water, to be introduced into pouch (27), Each of the above mentioned items may be determined as follows:

It is assumed that expulsion assembly (20) comprising a bag or pouch (27) enclosing a gelatin capsule (38) encapsulating a predetermined quantity of citric acid and a predetermined quantity of sodium bicarbonate and 5 cc of water, and an insignificant quantity of atmospheric air, and having displacement capacity of 12 cc, is disposed within container (10) having displacement capacity of 140 cc. One hundred (100) cc of flowable produce (19) is introduced into container (10) around expulsion means (20), and barrier member (22) and perforated tubing (25) are put in place, and top (13) is affixed on container (10) to close it. The aggregate head space above the liquid in container (10) and expulsion assembly (20) is 28 cc, occupied by atmospheric air. The pressure under which product (19) is to be discharged from container (10) should be within the range of maximum pressure level of 144 psig. and minimum pressure level of 100 psig.

It is assumed that one atmospheric pressure at normal temperature measures 14.4 psig., and 144 psig. is equivalent to ten (10) atmospheric pressures.

It is assumed that the complete reaction of 1.45 gms. of citric acid with 1.9 gms. of sodium bicarbonate in aqueous medium generates 1 gm. of carbon dioxide gas, and that 1000 cc of carbon dioxide gas weigh 1.82 gms., and that 1 gm. of carbon dioxide gas measures 549.45 cc at normal temperature and pressure.

It is assumed that 0.02639 gms. of citric acid is required to completely react with enough quantity of sodim bicarbonate in aqueous medium in order to generate 1 cc of carbon dioxide gas compressed under 144 psig., and 0.03458 gms. of sodium bicarbonate is required to completely react with enough quantity of citric acid in aqueous medium in order to generate 1 cc of carbon dioxide gas compressed under 144 psig.

The air in 28 cc of head space pressurized under 14.4 psig. provides a quantity of pressurizing gas for only 2.8 cc pressurized under 144 psig. The displacement capacity in container (10) after all the 100 cc of product (19) is completely discharged from container (10) is calculated as follows:

$$100+28-2.8=125.2 \text{ cc} \ldots$$

The quantity of sodium bicarbonate required to generate carbon dioxide gas compressed under 144 psig. in a space of 125.2 cc is calculated according to the above mentioned mathematical formula as follows:

$$125.2\times0.03458=4.32 \text{ gms.},$$

rounded to 4.4 gms of sodium bicarbonate. (It is permitted to exceed the calculated quantity of component (37), which may help the chemical reaction.)

Following are the stages of the internal pressure in pouch (27) and its incremental expansion in size in the course of completely discharging product (19) out of container (10):

An additional quantity of pressurizing gas is required to provide another 25.2 cc of gas pressurized under 144 psig. for raising the pressure in the total head space of 28 cc within container (10) to 144 psig. This 25.2 cc is the difference between 28 cc and 2.8 cc. This additional quantity of pressurizing gas is generated by reacting an additional quantity of citric acid with the sodium bicarbonate within pouch (27), which is calculated according to the above mentioned mathematical formula as follows:

$$25.2\times0.2639=0.665 \text{ gms. citric acid} \ldots$$

This quantity of citric acid is encapsulated in capsule (38), which is deposited within pouch (27) and mixes with the sodium bicarbonate and water therein. After a predetermined period of time, this capsule disintegrates or dissolves and releases its content within pouch (27). Its 0.665 gms. content of citric acid reacts with the sodium bicarbonate within pouch (27) and generates the required quantity of additional pressurizing gas to raise the pressure within this space of 28 cc to 144 psig.

Product (19) is discharged from container (10) at staggered intervals in small increments, and pouch (27) gradually expands therein from 28 cc to 40.32 cc, that is an additional 12.32 cc when eventually its internal pressure drops from 144 psig. to 100 psig. for the first time. This is calculated as follows:

$$(28\times144) \text{ divided by } 100=40.32 \text{ cc.}$$

This 40.32 cc of head space requires an additional 12.32 cc of gas pressurized under 144 psig. for raising its internal pressure to 144 psig. This 12.32 cc is the difference between 40.32 cc and 28 cc. This additional quantity of pressurizing gas is generated by reacting the following quantity of citric acid with the sodium bicarbonate within pouch (27), which is calculated as follows:

$$12.32 \times 0.02639 = 0.325 \text{ gms. citric acid} \ldots$$

This quantity of 0.325 gms. of citric acid is encapsulated in one of closed pocket members (34) which is scheduled to open first among the plurality of closed pocket members (34) which are scheduled to open within pouch (27).

By the same method of the calculations mentioned above, the size of pouch (27) should further increase by 17.68 cc when its internal pressure drops from 144 psig. to 100 psig. for the second time, and the closed pocket member scheduled to open second should encapsulate the following quantity of citric acid:

$$17.68 \times 0.02639 = 0.47 \text{ gms. citric acid, and} \ldots$$

Pouch (27) should expand another 25.2 cc when its internal pressure drops to 100 psig. for the third time, and closed pocket member scheduled to open third should encapsulate, $$25.2 \times 0.02639 = 0.674 \text{ gms. citric acid, and} \ldots$$

Pouch (27) should expand further another 36.7488 cc when its internal pressure drops to 100 psig. for the fourth time, and closed pocket member scheduled to open fourth should encapsulate $$36.7488 \times 0.02639 = 0.97 \text{ gms. citric acid, and} \ldots$$

Pouch (27) can expand within container (10) only another 9.5 cc when its internal pressure drops to 100 psig. for the fifth time, and . . .

closed pocket member scheduled to open fifth should encapsulate $$9.5 \times 0.02639 = 0.25 \text{ gms. citric acid} \ldots$$

Accordingly, the internal pressure in pouch (27) has to rise five (5) times from 100 psig. to 144 psig., and requires five (5) closed pocket members, each containing one of the above mentioned quantities of citric acid. The above date identify item (d) is determined as follows:

The determination of the length of each extension of the pocket and closure members and the distances between identifiable spots on each of walls (27*c*) and (27*d*) each time the internal pressure in the dispenser drops from predetermined maximum to predetermined minimum pressure levels are as follows:

I. An experimental pouch (27) having walls (27*a*) and (27*b*) made of transparent plastic material. Each of interior walls (27*c*) and (27*d*) is marked at random with identifiable markings or spots. Each pair of identifiable spots includes one member identifiable spot on each of interior walls (27*c*) and (27*d*). Five of such pairs of spots are identified on interior walls (27*c*) and (27*d*) of experimental pouch (27).

II. An experimental container (10) having the shape and dimensions of the container intended to be utlized in the mass production of the dispenser, and is constructed from any suitable metal or transparent material.

III. An experimental expulsion assembly (20) comprised of pouch (27) in step I, in which are deposited capsule (38) encapsulating 0.665 gms. of citric acid, component (36), and 4.4 gms. of sodium bicarbonate, and 5 cc of water, component (37), in contact with each other. Then pouch (27) is closed by sealing its contacting top side (30).

IV. An experimental apparatus is assembled by disposing experimental expulsion assembly (20) of step III within experimental container (10) of step II and adding therein around expulsion assembly (20) 100 cc of product (19). Perforate tubing (25) and barrier (22) are put in place, and top (13) is affixed to container (10). After elapse of time of 4 minutes, capsule (38) has disintegrated and components (36) and (37) react and produce a quantity of carbon dioxide pressurizing gas which raises the pressure within pouch (27) to 144 psig., and this pressurized apparatus is ready for use.

V. Product (19) is discharged from container (10) at intervals in small increments, and the internal pressure within container (10) is measured after each time product (19) is discharged. When the internal pressure drops to 100 psig., pouch (27) has expanded 12.32 cc within container (10) and the distance between the member spots of the identifiable pairs of spots, has increased.

VI. The image of the interior of experimental container (10) and that of the experimental expulsion assembly (20), and their component parts are reproduced by an imagery process or by photography or by any other suitable process at the time when the internal pressure in container (10) drops to 100 psig. The distance between two members of an identifiable pair of spots which are suitably located on each of interior walls (27*c*) and (27*d*), is measured.

VII. Step IV is repeated, using experimental container (10), experimental expulsion assemly (20) containing 4.4 gms. of sodium bicarbonate, 5 cc of water, capsule (38) encapsulating 0.665 gms. of citric acid, and adding one closed pocket member encapsulating 0.325 gms. citric acid disposed within pouch (27), as follows: the end of its pocket extension member (a) and the end of its closure extension member (b) are attached by weld portions (35) to each member of the identifiable pair of spots on interior walls (27*c*) and (27*d*) identified in step VI, and the total length of its pocket and closure extension members is equal to the distance measured between the two members of the identifiable pair of spots, identified and measured in step VI.

VIII. Step V is repeated, allowing the internal pressure in container (10) to drop for the second time to 100 psig., and thereby pouch (27) has expanded another 17.68 cc.

IX. Step VI is repeated, and the distance between another pair of identifiable spots, one member spot on each of walls (27*c*) and (27*d*), is measured.

X. Step VII is repeated, and in addition, another closed pocket member encapsulating 0.47 gms. of citric acid is disposed within pouch (27) as follows: the end of its pocket extension member (a) and the end of its closure extension member (b) are attached by weld portions (35) to each member of the identifiable pair of spots on interior walls (27*c*) and (27*d*) identified in step IX, and the total length of its pocket extension (a) plus that of its closure extension (b) is equal to the distance measured between the two members of the identifiable pair of spots, identified and measured in step IX.

XI. Step VIII is repeated, allowing the internal pressure in container (10) to drop for the third time to 100 psig., and thereby pouch (27) has expanded an additional 25.52 cc.

XII. Step IX is repeated, and the distance between another pair of identifiable spots, one member spot on each of walls (27*c*) and (27*d*), is measured.

XIII. Step X is repeated, and in addition, another closed pocket member encapsulating 0.674 gms. of citric acid is disposed within pouch (27) as follows: the end of its pocket extension member (a) and the end of its closure extension member (b) are attached by weld portions (35) to each member of the identifiable pair of spots on interior walls (27*c*) and (27*d*) identified in step XII, and the total length of its pocket extension (a) plus the length of its closure extension (b) is equal to the distance between the two members of the identifiable pair of spots, identified and measured in step XII.

XIV. Step XI is repeated, allowing the internal pressure within container (10) to drop for the fourth time to 100 psig., and thereby pouch (27) has expanded an additional 36.75 cc.

XV. Step XII is repeated and the distance between another pair of identifiable spots, one member spot on each of wall (27*c*) and (27*d*), is measured.

XVI. Step XIII is repeated and in addition another pocket member encapsulating 0.97 gms. of citric acid is disposed within pouch (27) as follows: the end of its pocket extension member (a) and the end of its closure extension (b) are attached by weld portions (35) to each member of the identifiable pair of spots on interior walls (27*c*) and (27*d*) identified in step XV, and the total length of its pocket extension (a) plus that of its closure extension (b) is equal to the distance between the two members of the identifiable pair of spots, identified and measured in step XV.

XVII. Step XIV is repeated, allowing the internal pressure in container (10) to drop for the fifth time to 100 psig. and pouch (27) being confined within container (10), can expand only another 9.5 cc.

XVIII. Step XV is repeated and the distance between the other pair of identifiable spots, one member spot on each of walls (27*c*) and (27*d*), is measured.

XIX. Step XVI is repeated, and in addition another closed member of pockets (34) encapsulating 0.25 gms. of citric acid is disposed within pouch (27) as follows: the end of its pocket extension member (a) and the end of its closure extension member (b) are attached by weld portions (35) to each member of the identifiable pair of spots marked on interior walls (27*c*) and (27*d*) identified in step XVIII, and the total length of its pocket extension member (a) plus the length of its closure extension member (b) is equal to the distance between the two members of the identifiable pair of spots identified and measured in step XVIII.

After dispensing the product from container (10) is completed, pouch (27) will line the interior of container (10).

The above is the data required to manufacture and asseble the above mentioned dispenser. In mass production, expulsion assembly (20) in step XIX is duplicated, and the dispenser is assembled and completed on the production line. By following the above mentioned method, dispensers of other specifications can be processed as well.

For practical purposes, the internal pressure within pouch (27) and expulsion assembly means (20) is synonymous and is equivalent to the internal pressure within container (10).

All quantities, pressures, volumes and measurements given above are in approximate numbers and are assumed accurate.

While certain illustrative embodiments of the invention have been described with particularity, it will be understood that various other modifications will be readily apparent to those skilled in the art without departing from the scope and spirit of the invention. Accordingly, it is not intended that the scope of the claims appended hereto be limited to the description set forth herein but rather that the claims be construed as encompassing all equivalents of the present invention which are apparent to those skilled in the art to which the invention pertains.

What is claimed is:

1. In an aerosol type dispenser, internal expulsion means for developing and maintaining gaseous dispensing pressure between predetermined maximum and minimum pressure levels for a product within a container of the dispenser, said expulsion means comprising an enclosed fluid impermeable flexible pouch disposed within said dispenser and having a pair of facing wall members, a plurality of pocket members disposed within said pouch in spaced relation to one another and affixed to the interior of a first of said wall members, closure members associated with the interior of the other said wall member closing each of said pocket members and releasably adhering to its contacting surfaces, a predetermined quantity of a first component of a two-component gas generation system disposed within each pocket member, a predetermined quantity of a second component of said two-component gas generation system disposed within said pouch and externally of said closed pocket members, starting delay means carrying a predetermined quantity of said first component disposed within said pouch in contact with said predetermined quantity of said second component for causing the initial generation of gas after a prescribed period of time, said pocket members being sequentially separable from said closure members to empty their contents into admixture with said second component to generate more gas as said pouch expands due to the dispensing of said product, each pocket member having a first extension member of a predetermined length affixed at its end to one member spot of an identifiable pair of spots comprising one identifiable spot on each of said pair of facing walls of said pouch, and each pocket member being releasably closed by a respective said closure member having a second extension member of a predetermined length affixed at its end to the other spot of said identifiable pair of spots, whereby, dispensing of said product causes the internal pressure within said container to alternate continuously between said predetermined minimum and maximum pressure levels, until dispensing said product is complete, said pouch increases in size to a predetermined capacity each time the internal pressure within said dispenser drops from said predetermined maximum to said predetermined minimum pressure levels, as the product is dispensed, the distance between said ends of said first and second extension members of said pocket and said closure members of each of said closed pocket members exceeds the total predetermined length of said pocket extension member plus the predetermined length of said closure extension member which causes sequential separation of said pocket members from their respective closure members and serial opening of each of said closed pocket members and discharging and adding of their contents sequentially each time the internal pressure in said dispenser drops to said predetermined minimum pressure level, whereby, coordination of said range of predetermined maximum and minimum pressure levels, the lengths of the extension members of each of said pocket and closure members of each of said plurality of closed pocket members, the quantity of said first component enclosed within each of said pocket members, the order of sequence of the opening of each of said closed pocket members, and the quantity of said second component deposited within said pouch permit dispensing of said product within said predetermined maximum and minimum pressure levels.

2. In an aerosol type dispenser, internal expulsion means for developing and maintaining gaseous dispensing pressure between predetermined maximum and minimum pressure levels for a product within a container of the dispenser, said expulsion means comprising an enclosed fluid impermeable flexible pouch disposed within said dispenser and having a pair of facing wall members, a plurality of interconnected pocket members disposed within said pouch in spaced relation to one another and affixed to the interior of a first of said wall members, a common closure member associated with the interior of the other said wall member closing each of said pocket members and releasably adhering to its contacting surfaces, a predetermined quantity of a first component of a two-component gas generation system disposed within each pocket member, a predetermined quantity of a second component of said two-component gas generation system disposed within said pouch and externally of said closed pocket members, starting delay means carrying a predetermined quantity of said first component disposed within said pouch in contact with said predetermined quantity of said second component for causing the initial generation of gas after a prescribed period of time, said pocket members being sequentially separable from its respective closure member to empty their contents into admixture with said second component to generate more gas as said pouch expands due to the dispensing of said product, each pocket member having a first extension member of a predetermined length affixed at its end to one member spot of an identifiable pair of spots comprising one identifiable spot on each of said pair of facing walls of said pouch, and each pocket member being releasably closed by a respective said closure member having a second extension member of a predetermined length affixed at its end to the other spot of said identifiable pair of spots, whereby, dispensing of said product causes the internal pressure within said container to alternate continuously between said predetermined minimum and maximum pressure levels, until dispensing said product is complete, said pouch increases in size to a predetermined capacity each time the internal pressure within said dispenser drops from said predetermined maximum to said predetermined minimum pressure levels, as the product is dispensed, the distance between said ends of said first and second extension members of said pocket and said closure members of each of said closed pocket members exceeds the total predetermined length of said pocket extension member plus the predetermined length of said closure extension member which causes sequential separation of said pocket members from their respective closure members and serial opening of each of said closed pocket members and discharging and adding of their contents sequentially each time the internal pressure in said dispenser drops to said predetermined minimum pressure level, whereby, coordination of said range of predetermined maximum and minimum pressure levels, the lengths of the extension members of each of said pocket and closure members of each of said plurality of closed pocket members, the quantity of said first component enclosed within each of said pocket members, the order of sequence of the opening of each of said closed pocket members, and the quantity of said second component deposited within said pouch permit dispensing of said product within said predetermined maximum and minimum pressure levels.

3. In a regulated self-pressurizing dispensing apparatus of the type having an outer container for developing and maintaining gaseous dispensing pressure between predetermined maximum and minimum pressure levels for a product being dispensed, a manually actuable atomizing and dispensing valve on said container, a dispensible flowable medium within said container to be dispensed, and means within said container for providing dispensing pressure for said medium comprising, a liquid impermeable expansible flexible pouch disposed within said container, said dispensible medium disposed externally of said pouch within said container, a pair of sheets permanently attached on their outer surfaces to the inner facing surfaces of said pouch and releasably adhered to one another over substantially their entire contacting surfaces, at least one of said sheets having a plurality of pocket members in its surface in spaced positions to one another and each carrying an aliquot of first component of a two-component gas generation system, the other sheet enclosing and encapsulating the first component in said two-component gas generation system disposed within said pouch and externally of said pocket members, starting delay means carrying a predetermined quantity of said first component disposed within said pouch in contact with said second component for causing the initial generation of gas after a predetermined period of time, upon outward expansion of the pouch due to the pressure of gas generated therein and the evacuation of said dispenser by dispensing said medium through said valve, said closed pocket members being adapted to gradually separate from their closures and open sequentially, thereby permitting said aliquots of said first component to contact said second component and generate additional quantities of pressurizing gas within said pouch, each pocket member having a first extension of a predetermined length affixed at its end to one member spot of an identifiable pair of spots comprising one identifiable spot on each of said pair of facing walls of said pouch, and each pocket member being releasably closed by a respective said closure member having a second extension member of a predetermined length affixed at its end to the other spot of said identifiable pair of spots, whereby, dispensing of said product causes the internal pressure within said container to alternate continuously between said predetermined minimum and maximum pressure levels, until dispensing said product is complete, said pouch increases in size to a predetermined capacity each time the internal pressure within said dispenser drops from said predetermined maximum to said predetermined minimum pressure levels, as the product is dispensed, the distance between said ends of said first and second extension members of said pocket and said closure members of each said closed pocket members exceeds the total predetermined length of said pocket extension member plus the predetermined length of said closure extension member which causes sequential separation of said pocket members from their respective closure members and serial opening of each of said closed pocket members and discharging and adding of their contents sequentially each time the internal pressure in said dispenser drops to said predetermined minimum pressure level, whereby, coordination of said range of predetermined maximum and minimum pressure levels, the lengths of the extension members of each of said pocket and closure members of each of said plurality of closed pocket members, the quantity of said first component enclosed within each of said pocket members, the order of sequence of the the opening of each of said closed pocket members, and the quantity of said second component deposited within said pouch permit dispensing of said product within said predetermined maximum and minimum pressure levels.

4. In a regulated self-pressurizing dispensing apparatus of the type having an outer container for developing and maintaining gaseous dispensing pressure between predetermined maximum and minimum pressure levels for a product being dispensed, a manually actuable atomizing and dispensing valve on said container, a dispensible flowable medium within said container to be dispensed, and means within said container for providing dispensing pressure for said medium comprising a liquid impermeable expansible flexible pouch disposed within said container, said dispensible medium disposed externally of said pouch within said container, a pair of two generally congruent sheets permanently attached on their outer surfaces to the inner facing surfaces of said pouch and releasably adhered to one another along at least portions of their respective margins, at least one of said sheets having a plurality of pockets in its surface in spaced positions to one another and each carrying an aliquot of first component of a two-component carbon dioxide gas generation system, the other sheet enclosing the first component in said pocket members, a predetermined quantity of a second component of said two-component carbon dioxide gas generation system disposed within said pouch and externally of said pocket members, starting delay means carrying a predetermined quantity of said first component disposed within said pouch in contact with said second component for causing the initial generation of gas after a predetermined period of time, upon outward expansion of the pouch due to the pressure of gas generated therein and the evacuation of said dispenser by dispensing said medium through said valve, said closed pocket members being adapted to gradually separate from their closures and open sequentially, thereby permitting said aliquots of said first component to contact said second component and generate additional quantities of carbon dioxide gas within said pouch, each pocket member having a first extension of a predetermined length affixed at its end to one member spot of an identifiable pair of spots comprising one identifiable spot on each of said pair of facing walls of said pouch, and each pocket member being releasably closed by a respective said closure member having a second extension member of a predetermined length affixed at its end to the other spot of said identifiable pair of spots, whereby, dispensing of said product causes the internal pressure within said container to alternate continuously between said predetermined minimum and maximum pressure levels, until dispensing said product is complete, said pouch increases in size to a predetermined capacity each time the internal pressure within said dispenser drops from said predetermined maximum to said predetermined minimum pressure levels, as the product is dispensed, the distance between said ends of said first and second extension members of said pocket and said closure members of each said closed pocket members exceeds the total predetermined length of said pocket extension member plus the predetermined length of said closure extension member which causes sequential separation of said pocket members from their respective closure members and serial opening of each of said closed pocket members and discharging and adding of their contents sequentially each time the internal pressure in said dispenser drops to said predetermined minimum pressure level, whereby, coordination of said range of predetermined maximum and minimum pressure levels, the lengths of the extension members of each of said pocket and closure members of each of said plurality of closed pocket members, the quantity of said first component enclosed within each of said pocket members, the order of sequence of the the opening of each of said closed pocket members, and the quantity of said second component deposited within said pouch permit dispensing of said product within said predetermined maximum and minimum pressure levels.

5. Expulsion means for developing and maintaining gaseous dispensing pressure in a container for a product being dispensed from said container, said means comprising a closed, fluid impermeable, flexible pouch adapted to be disposed within said container, said closed pouch having a pair of facing wall members, a plurality of pocket members disposed within said pouch in spaced positions to one another and each is affixed to the interior of a first of said facing wall members, a closure member for each pocket member associated with the interior of the other of said facing wall member and closing each of said pocket members and releasably adhering to its contacting surfaces, a predetermined quantity of a first component of a two-component gas generation system disposed within each pocket member, a predetermined quantity of a second component of said two-component gas generation system disposed within said pouch and externally of said closed pocket members, starting delay means carrying a predetermined quantity of said first component disposed within said pouch in contact with said second component for causing the initial generation of pressurizing gas after a predetermined period of time, said pocket members being sequentially separable from their closure members to empty their contents into admixture with said second component to generate more pressurizing gas as said pouch expands due to the dispensing of said product, each pocket member having a first extension member of a predetermined length affixed at its end to one member spot of an identifiable pair of spots comprising one identifiable spot on each of said pair of facing walls of said pouch, and each pocket member being releasably closed by a respective said closure member having a second extension member of a predetermined length affixed at its end to the other spot of said identifiable pair of spots, whereby, dispensing of said product causes the internal pressure within said container to alternate continuously between said predetermined minimum and maximum pressure levels, until dispensing said product is complete, said pouch increases in size to a predetermined capacity each time the internal pressure within said dispenser drops from said predetermined maximum to said predetermined minimum pressure levels, as the product is dispensed, the distance between said ends of said first and second extension members of said pocket and said closure members of each of said closed pocket members exceeds the total predetermined length of said pocket extension member plus the predetermined length of said closure extension member which causes sequential separation of said pocket members from their respective closure members and serial opening of each of said closed pocket members and discharging and adding of their contents sequentially each time the internal pressure in said dispenser drops to said predetermined minimum pressure level, whereby, coordination of said range of predetermined maximum and minimum pressure levels, the lengths of the extension members of each of said pocket and closure members of each of said plurality of closed pocket members, the quantity of said first component enclosed within each of said pocket members, the order of sequence of the opening of each of said closed pocket members, and the quantity of said second component deposited within said pouch permit dispensing of said product within said predetermined maximum and minimum pressure levels.

6. Expulsion means for developing and maintaining gaseous dispensing pressure in a container for a product being dispensed from said container, said means comprising a closed, fluid impermeable, flexible pouch adapted to be disposed within said container, said closed pouch having a pair of facing wall members, a plurality of pocket members disposed within said pouch in spaced positions to one another affixed to the interior of a first of said facing wall members, a common closure member associated with the interior of the other of said facing wall member and closing each of said pocket members and releasably adhering to its contacting surfaces, a predetermined quantity of a first component of a two-component gas generation system disposed within each pocket member, a predetermined quantity of a second component of said two-component gas generation system disposed within said pouch and externally of said closed pocket members, starting delay means carrying a predetermined quantity of said first component disposed within said pouch in contact with said second component for causing the initial generation of pressurizing gas after a predetermined period of time, said pocket members being sequentially separable from their closure members to empty their contents into admixture with said second component to generate more pressurizing gas as said pouch expends due to the dispensing of said product, each pocket member having a first extension member of a predetermined length affixed at its end to one member spot of an identifiable pair of spots comprising one identifiable spot on each of said pair of facing walls of said pouch, and each pocket member being releasably closed by a respective said closure member having a second extension member of a predetermined length affixed at its end to the other spot of said identifiable pair of spots, whereby, dispensing of said product causes the internal pressure within said container to alternate continuously between said predetermined minimum and maximum pressure levels, until dispensing said product is complete, said pouch increases in size to a predetermined capacity each time the internal pressure within said dispenser drops from said predetermined maximum to said predetermined minimum pressure levels, as the product is dispensed, the distance between said ends of said first and second extension members of said pocket and said closure members of each of said closed pocket members exceeds the total predetermined length of said pocket extension member plus the predetermined length of said closure extension member which causes sequential separation of said pocket members from their respective closure members and serial opening of each of said closed pocket members and discharging and adding of their contents sequentially each time the internal pressure in said dispenser drops to said predetermined minimum pressure level, whereby, coordination of said range of predetermined maximum and minimum pressure levels, the lengths of the extension members of each of said pocket and closure members of each of said plurality of closed pocket members, the quantity of said first component enclosed within each of said pocket members, the order of sequence of the opening of each of said closed pocket members, and the quantity of said second component deposited within said pouch permit dispensing of said product within said predetermined maximum and minimum pressure levels.

7. In the dispenser defined in claims 1, 2, 3, or 4 wherein said pouch comprised of three-layer laminated plastic, the external layer being Mylar polyester (0.5) to (3) mils thick, the inner layer being low density polyethylene (0.5) to (20) mils thick, and the middle layer being saran deposited by spraying at least one of the inner surfaces of said Mylar and polyethylene layers, and said pouch is closed and completely enclosed.

8. In the dispenser defined in claim 7 wherein, said pocket members comprised of two-layer plastic lamination having an exterior layer of low density polyethylene (0.5) to (20) mils thick, and an interior layer of polypropylene (0.1) to (10) mils thick, said closure members comprised of three-layer plastic sandwich lamination having an inner Mylar polyester layer of (0.3) to (3.00) mils thickness, the outer layers of the sandwich having low density polyethylene of (0.3) to (20) mils thick.

9. In the dispenser defined in claim 8 wherein, each of said pocket members and said starting delay means encapsulating said predetermined first component comprising at least a compound selected from the class consisting of a water soluble mineral acid, carboxylic acid and citric acid and said second component is comprised of at least one compound selected from the class consisting of barium carbonate, calcium carbonate and sodium bicarbonate in aqueous medium and said generated gas being carbon dioxide gas.

10. In the dispenser defined in claim 9 wherein, each of said plurality of pocket members is individually separated and independent from the others.

11. In the dispenser defined in claim 10 wherein, said starting means comprising a gelatin capsule.

12. In the dispenser defined in claim 11 wherein, the end of each of said extension members of each of said pocket members of said plurality of pocket members is affixed by proportionately short heat sealed weld portion to one of two facing walls of said pouch at a predetermined spot, and each of said extension members of each of said closure members respective to said pocket members is affixed by proportionately short heat sealed weld portion to the outer of the two facing walls of said pouch at a predetermined spot, said spots constitute two member spots of an identifiable pair of spots, one of which is located on each of said facing walls of the pouch.

13. In the dispenser defined in claim 12 wherein, said product to be dispensed is comprised of at least one component selected from the class consisting of bromo-chlorl-difluoro-methane, chloro-penta-fluoro-ethane, chloro-trifluoro-methane, and dibromo-tetra-fluoro-ethane.

14. In the dispenser defined in claim 13 wherein, a foraminous barrier is located under an intake valve and a perforated tubing located alongside and internally of the container to facilitate the flow of the contents in the container to said valve intake.

15. In the dispenser defined in claims 1, 2, 3, 4, 8, 9, 10, 11, 12, 13 or 14 wherein, the radioactivity at the surface of said dispenser and its component parts and accessories as well as that of the product dispensed therefrom does not exceed 0.1 milliroentgen per hour.

16. In the dispensers defined in claim 7 wherein the radioactivity at the surface of said dispenser and its component parts and accessories as well as that of the product dispensed therefrom does not exceed 0.1 milliroentgen per hour.

* * * * *

UNITED STATES PATENT AND TRADEMARK OFFICE
CERTIFICATE OF CORRECTION

PATENT NO. : 4,909,420

DATED : March 20, 1990

INVENTOR(S) : Ellis M. Reyner

It is certified that error appears in the above-identified patent and that said Letters Patent is hereby corrected as shown below:

On the title page insert [73] Assignee:
--Joy Research, Incorporated--.

Column 3, line 62, after the word "sealed", delete the word "protions' and insert the word -portions- Column 8, line 6, before the word "bicarbonate", delete the word "sodim" and insert the word -sodium- and in column 8, line 46, after the "25.2X", delete the number "0.2639" and insert the number -0.02639-

Column 11, line 59, before the word "the" delete the word "asseble" and insert the word -assemble- Col. 13, Claim 2, line 43, after the word "from", delete the word "its" and insert the word -their- Col. 14, In claim 3, line 28, before the word "flowable", delete the word "dispensible" and insert the word -dispensable- In claim 4, line 38, before the word "flowable", delete the word "dispensible" and insert the word -dispensable- and in line 42 after the word "said", delete the word "dispensible" and insert the word -dispensable-

Signed and Sealed this

Twenty-seventh Day of August, 1991

*Attest:*

HARRY F. MANBECK, JR.

*Attesting Officer*

*Commissioner of Patents and Trademarks*